US006799764B2

(12) United States Patent
Ingold

(10) Patent No.: US 6,799,764 B2
(45) Date of Patent: Oct. 5, 2004

(54) LAYERED ARCHERY TARGET

(75) Inventor: Michael E. Ingold, Salisbury, NC (US)

(73) Assignee: McKenzie Sports Products, Salisbury, NC (US)

( * ) Notice: Subject to any disclaimer, the term of this patent is extended or adjusted under 35 U.S.C. 154(b) by 45 days.

(21) Appl. No.: 10/453,286

(22) Filed: Jun. 2, 2003

(65) Prior Publication Data

US 2003/0222403 A1 Dec. 4, 2003

Related U.S. Application Data

(60) Provisional application No. 60/385,273, filed on Jun. 3, 2002.

(51) Int. Cl.[7] ..... F41J 3/00
(52) U.S. Cl. ..... 273/403; 273/408
(58) Field of Search ..... 273/403, 404, 273/407, 408

(56) References Cited

U.S. PATENT DOCUMENTS

| | | | | | |
|---|---|---|---|---|---|
| 3,088,738 | A | | 5/1963 | Meyer | |
| 3,329,431 | A | * | 7/1967 | Roesner | 273/403 |
| 4,076,246 | A | | 2/1978 | Meyer | |
| 4,126,501 | A | | 11/1978 | Croll | |
| 4,244,585 | A | | 1/1981 | Croll | |
| 4,695,060 | A | * | 9/1987 | Pilgrim | 273/404 |
| 4,813,684 | A | * | 3/1989 | Bruno | 273/403 |
| 4,940,244 | A | | 7/1990 | Batts, III | |
| 5,290,042 | A | * | 3/1994 | Worley et al. | 273/408 |
| 5,354,066 | A | * | 10/1994 | Swanson et al. | 273/408 |
| 5,465,977 | A | | 11/1995 | Mann | |
| 5,577,734 | A | * | 11/1996 | Conroy | 273/407 |
| 5,865,440 | A | | 2/1999 | Pulkrabek | |

* cited by examiner

*Primary Examiner*—Mark S. Graham
(74) *Attorney, Agent, or Firm*—Akin Gump Strauss Hauer & Feld, LLP

(57) ABSTRACT

An archery target assembly includes first and second end caps having a plurality of corners. The archery target further comprises a plurality of layers of foam, each layer having a corresponding plurality of corners. The layers are stacked in general alignment with one another between the first and second end caps with the plurality of corners of the layers of foam being in alignment such that a plurality of target faces are formed by edges of the layers of foam. A plurality of assembly cables connect the first and second end caps, each cable being disposed generally along a line formed at an apex of the aligned corners of the layers of foam. Each of the cables has a length which results in the layers of foam being compressed between the first and second end caps.

10 Claims, 4 Drawing Sheets

LAYERED ARCHERY TARGET

CROSS-REFERENCE TO RELATED APPLICATIONS

This application claims benefit of U.S. Provisional Patent Application No. 60/385,273, "Layered Archery Target", filed Jun. 3, 2002, the subject matter of which is incorporated herein by reference.

BACKGROUND OF THE INVENTION

This invention relates to archery targets and, more particularly, to a target constructed of multiple foam layers stacked between top and bottom generally planar end caps.

Various styles of archery targets and backstops are available to safely capture arrows. Desirable characteristics of such targets include the ability to safely capture an arrow and prevent it from passing through the target, ability of the target to be used with any style of arrow and arrow point, ease of arrow extraction, durability, low cost, ease of manufacture, portability, weather-resistance, and ease of maintenance.

One conventional archery target is constructed of compressed layers of cardboard. The layers are compressed by tightening threaded rods which extend through the assembly against planar end caps. The cardboard material is subject to weather damage, and tends to restrict arrow removal.

U.S. Pat. No. 5,865,440 discloses an archery target formed by a plurality of foam layers captured and compressed between first and second platens. The platens are disclosed to have smaller planar dimensions than the planar dimensions of the foam layers. Continuous bands are disclosed to extend around a circumference of the target. As the platens are smaller than the foam layers, the bands are disclosed to bite into outer edges of the foam layers, thus helping to maintain the foam layers in registry with one another and with the platens.

Shortcomings of the prior art include loosening of the target assembly with use, as the bands used to assemble the targets typically cannot be easily retightened once initially tensioned, nor readily replaced if damaged during use of the target. Furthermore, the sides of the target along which the bands lay may be used as a target face only at the considerable risk of striking and damaging a band. Therefore, a conventional cube-shaped target provides only two target faces suitable for capturing arrows.

In recognition of the deficiencies of the existing targets, the present target has been developed to provide a durable, portable, weather-resistant, and cost-effective archery target that may be used with all types of arrows and arrow points.

BRIEF SUMMARY OF THE INVENTION

Briefly stated the present invention is directed to an archery target. The archery target comprises first and second end caps having a plurality of corners. The archery target further comprises a plurality of layers of foam, each layer having a corresponding plurality of corners. The layers are stacked in general alignment with one another between the first and second end caps with the plurality of corners of the layers of foam being in alignment such that a plurality of target faces are formed by edges of the layers of foam. A plurality of assembly cables connect the first and second end caps, each cable being disposed generally along a line formed at an apex of the aligned corners of the layers of foam. Each of the cables has a length which results in the layers of foam being compressed between the first and second end caps.

BRIEF DESCRIPTION OF THE SEVERAL VIEWS OF THE DRAWINGS

The foregoing summary, as well as the following detailed description of the preferred embodiment of the invention, will be better understood when read in conjunction with the appended drawings. For the purpose of illustrating the invention, there is shown in the drawings an embodiment that is presently preferred. It should be understood, however, that the invention is not limited to the precise arrangements and instrumentalities shown. In the drawings.

DETAILED DESCRIPTION OF THE INVENTION

Figure 1:
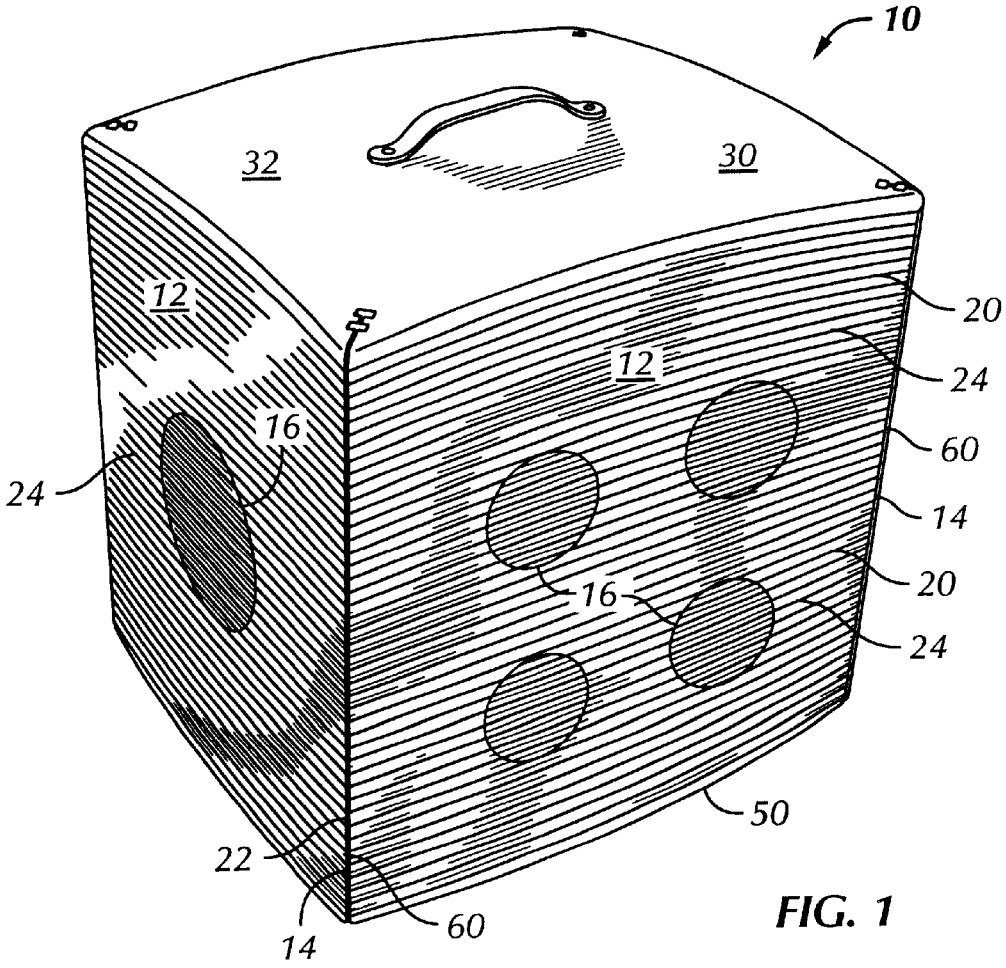
FIG. 1 is a perspective view of a layered archery target assembly in accordance with the present invention.

Certain terminology is used in the following description for convenience only and is not limiting. The words "right", "left", "top", and "bottom" designate directions in the drawings to which reference is made. The words "inwardly" and "outwardly" refer to directions toward and away from, respectively, the geometric center of the archery target and designated parts thereof. The terminology includes the words above specifically mentioned, derivatives thereof and words of similar import.

Referring now to FIGS. 1–5, wherein like numerals indicate like elements throughout, there is shown a layered archery target assembly, generally designated 10, in accordance with the present invention. FIG. 1 illustrates that a preferred embodiment of the target assembly 10 is constructed of first and second rigid end caps 30 and 50. Each end cap 30, 50 has a plurality of corners 40. The target assembly 10 further includes a plurality of layers 20 of closed cell polyethylene foam, each layer 20 having a plurality of corners 22 corresponding to the plurality of corners 40 of the end caps 30, 50. The layers 20 are stacked one on top of another, in face-to-face engagement in general alignment between the first and second rigid end caps 30 and 50 with the respective plurality of corners 22, 40 being in alignment such that a plurality of target faces 12 are formed by edges 24 of the foam layers 20. A plurality of assembly cables 60 connect the first and second end caps 30, 50. Each cable 60 is disposed generally along a line formed at an apex 14 formed by the aligned respective pluralities of corners 22, 40 of the foam layers 20 and the end caps 30, 50. Each of the assembly cables 60 has a length which results in the layers of foam 20 being compressed between the first and second end caps 30, 50 when the target assembly 10 is assembled.

In the embodiment illustrated, the end caps 30 and 50 as well as the foam layers 20 are formed in the shape of a rectangle. The archery target 10 thus illustrated has four planar target faces 12 formed by edges 24 of the foam layers 20. The target faces 12 intersect along intersection lines at the target apexes 14. The target faces 12 may have target shapes 16, such as a bulls eye, disposed thereon.

The number of layers 20 may be adjusted to achieve the desired height of the target assembly 10. The preferred number of layers 20 ranges from approximately 80 to approximately 200. Each individual layer 20 is preferably of a thickness between approximately one sixteenth and one-quarter of an inch, and preferably of about one-eighth of an inch. The layers 20 are cut from sheets of polyethylene foam, but could be individually molded without departing from the spirit and scope of the invention.

While the embodiment illustrated shows the end caps 30 and 50 and the foam layers 20 being generally rectangular in shape, it would be obvious from this disclosure to one skilled in the art that other shapes (for example, circular, triangular or square) could be substituted. Likewise, other overall target heights (for example, in the range of 6" inches to 36" inches) and other materials (for example, cardboard or carpet) could be substituted for the thickness and materials incorporated into the preferred embodiment without departing from the spirit and scope of the invention.

The layers 20 are captured between the first and second generally planar end caps 30 and 50, respectively. In a preferred embodiment, the first and second end caps 30, 50 are made from a rigid polymeric material, such as polypropylene, and are fabricated by injection molding techniques. The first and second end caps 30, 50 are generally identical. Therefore, only the first end cap 30 is described in detail herein.

Figure 2:
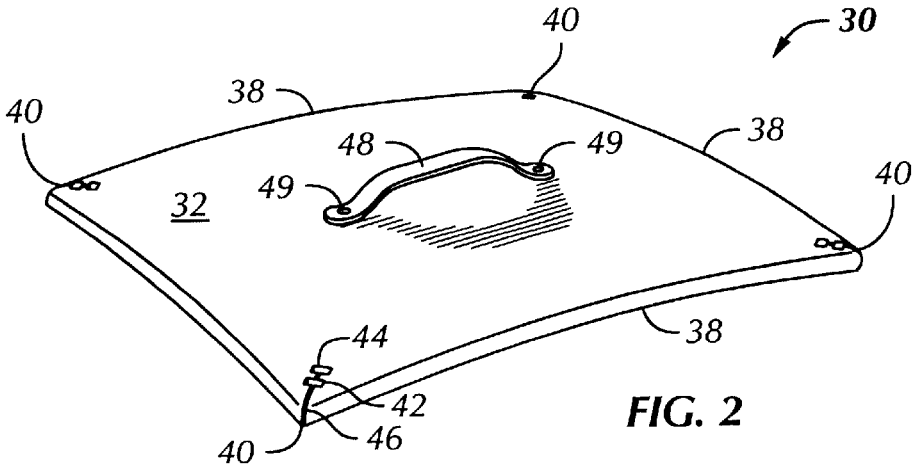
FIG. 2 is a top perspective view of an end cap used in the archery target assembly shown in FIG. 1.
Figure 3:
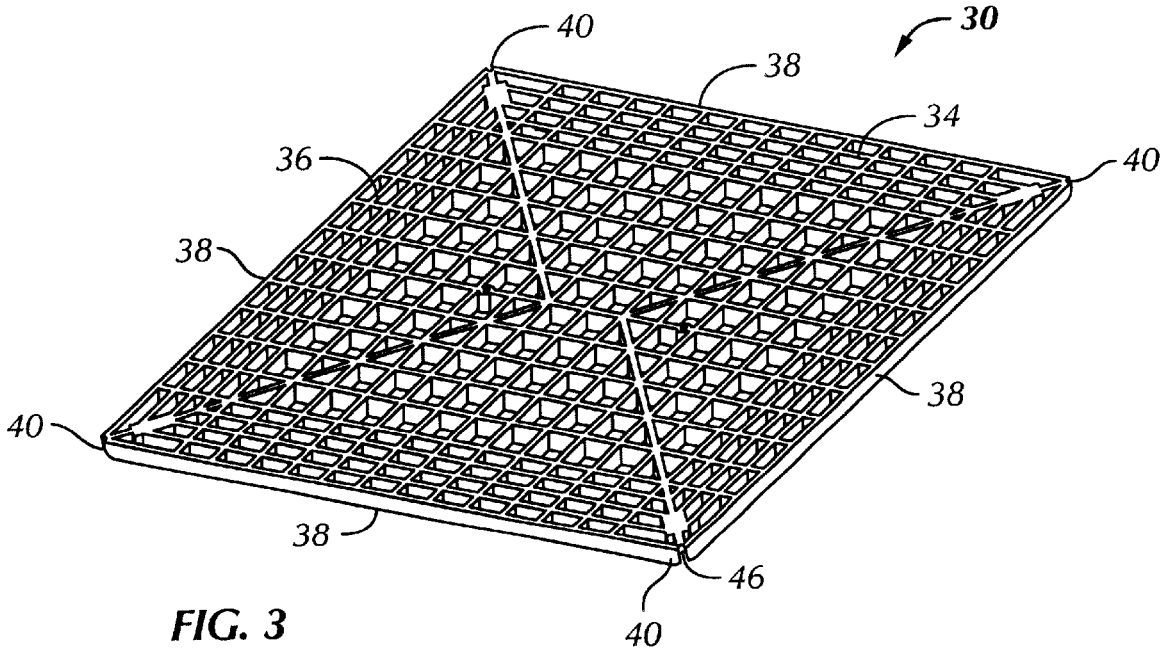
FIG. 3 is a bottom perspective view of the end cap shown in FIG. 2.
Figure 5:
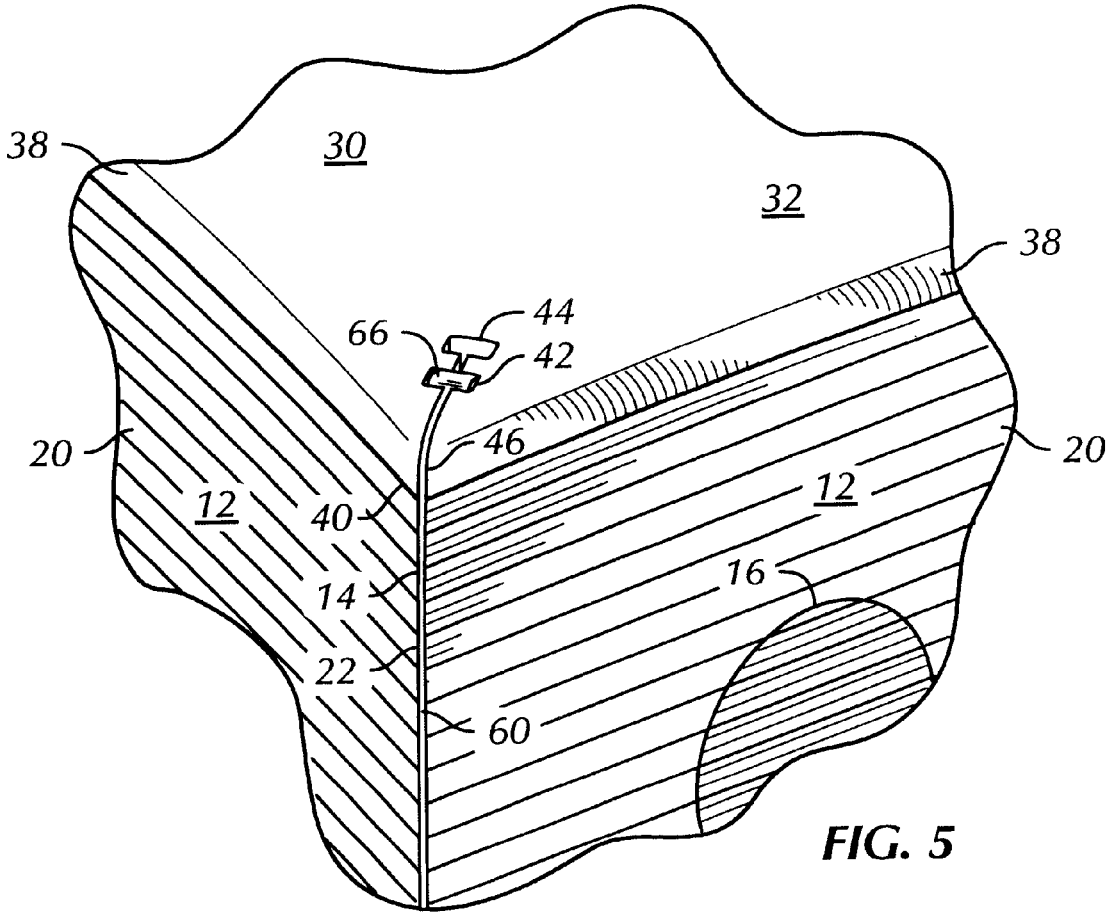
FIG. 5 is a greatly enlarged perspective view of one corner of the archery target assembly of FIG. 1.

As shown particularly in FIGS. 2, 3 and 5, the first end cap 30 is generally rectangular in shape, and generally complements circumferences of the layers 20. The first end cap 30 has an exterior face 32 and an interior face 34. In the preferred embodiment illustrated, the first end cap 30 has four edges 38 and four corners 40. Molded into the exterior face 32 at each corner 40 of the first end cap 30 is at least a first receptacle 42, and preferably a second receptacle 44, for each assembly cable 60. Each receptacle 42, 44 is adapted to releasably receive a corresponding barrel element 66 of the assembly cables 60, described in detail below. If the second receptacle 44 is provided, the corresponding barrel element 66 may be releasably received in the alternative in either the first or second receptacle, 42, 44. A cable groove 46 extends between the first and second receptacles 42 and 44, as well as between the first receptacle 42 and a tip of the corner 40. A handle 48 may be attached to the exterior face 32 in any conventional manner, such as by screws 49.

That the shape of the first end cap 30 generally complements that of the layers 20 facilitates assembly (described later herein), helps achieve uniform pressure across the entire surface of the layers 20 (which improves the performance of the target assembly 10 in use, described later herein), and improves durability of the target assembly 10, as the more rigid and durable edges 38 of the first end cap 30 help prevent wear and damage to the layers 20. The edges 38 of the first end cap 30 are radiused, to eliminate sharp edges which would interfere with use of the assembly cables 60, described in more detail hereinafter.

As shown in FIG. 3, a pattern of support ribs 36 are preferably provided on the interior side 34 of the first end cap 30. This type of ribbed structure yields a high degree of rigidity with reduced weight. High rigidity of the first end cap 30 is desirable inasmuch as a high degree of rigidity helps create uniform loading across the entire face of the layers 20. Uniform compression of the layers 20 across their entire face improves the performance of the target assembly 10. Low weight of the first end cap 30 is desirable inasmuch as low weight improves the portability of the target assembly 10. It would be obvious to one skilled in the art from this disclosure that other materials (for example, wood, metal, or other polymeric materials), fabrication techniques (for example, machining or stamping) and other support rib designs (for example, absence of support ribs or variation of the arrangement, size or thicknesses of the ribs) could be substituted for the materials, fabrication techniques, and rib design incorporated into the preferred embodiment of the first and second end caps 30, 50, without departing from the spirit and scope of the invention.

Figure 4:
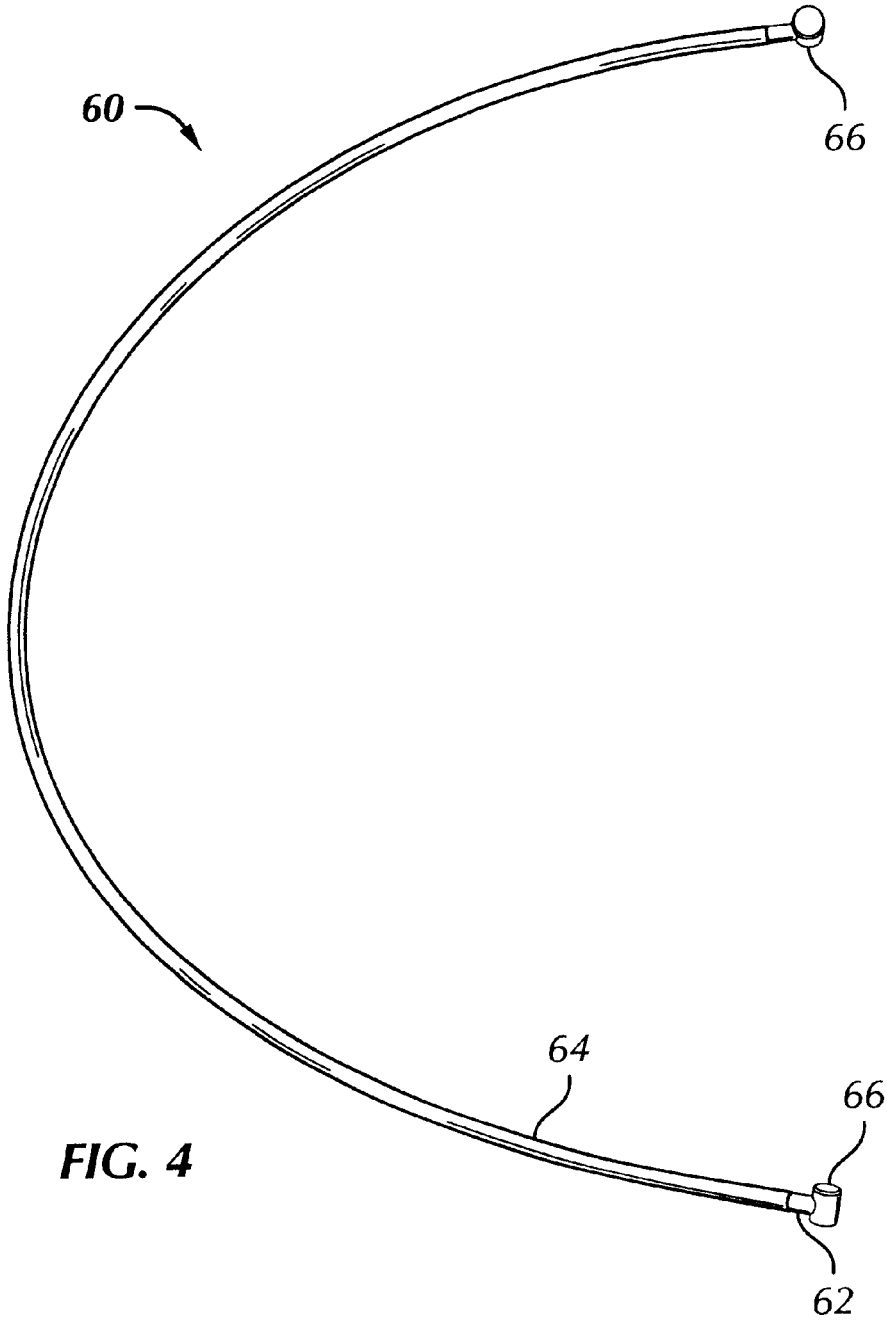
FIG. 4 is an enlarged top plan view of an assembly cable used in the archery target of FIG. 1.

Referring now to FIG. 4, a preferred embodiment of one of the assembly cables 60 is shown. Each assembly cable 60 is fabricated from zinc-coated steel cable 62 approximately 1/16" in diameter encased in a Nylon sheath 64. Each assembly cable 60 is provided with elements 66 at each end which are generally in the form of a barrel. It would be obvious to one skilled in the art from this disclosure that other assembly cable designs (for example, different cable materials (e.g., polyester fibers, stainless steel or plastic), or different cable thickness) could be substituted for the design incorporated into the preferred embodiment without departing from the spirit and scope of the invention.

Referring now to FIG. 5, the barrel elements 66 are dimensioned to be releasably received within either the first receptacle 42 (as is illustrated in FIG. 5) or the second receptacle 44. The assembly cable groove 46 is dimensioned to releasably receive the assembly cable 60, and directs the assembly cable 60 along an apex of the target assembly corner 40. It would be obvious to one skilled in the art from this disclosure that other barrel receiving slot and assembly cable groove designs (for example, different spacing of the barrel receiving slots or additional barrel receiving slots) could be substituted for the design incorporated into the preferred embodiment without departing from the spirit and scope of the invention. From this disclosure, the artisan would further recognize that other structures could be substituted for the first and second receptacles 42, 44 to secure the barrel elements 66, for example a slot formed by two protrusions extending from the exterior surface 32. Still further from this disclosure, the artisan would recognize that other conventional fastening systems, for example screws installed into threaded holes, could be substituted for the barrel elements 66 and first and second receptacles 42, 44.

Referring now particularly to FIGS. 1 and 5, the target assembly 10 is assembled by uniformly stacking the layers 20 between the first and second end caps 30, 50, with the foam layer corners 22 and edges 24 in general alignment with one another and with the end cap corners 40 and edges 38, respectively. The barrel elements 66 are then initially connected to the first receptacles 42 provided in each corner 40 of both the first and second end caps 30, 50, with the assembly cables 60 running along the lines of intersection 14 of the target faces 12. The length of the assembly cables 60 is selected to match the number of layers 20 such that when the barrel elements 66 are engaged in the first receptacles 42, the foam layers 20 are compressed to a degree which promotes effective capture of the arrows (not shown) as well as ease of arrow removal. It is desirable that the foam layers 20 be compressed within this range uniformly across the entire face of the layer 20. Uniform compression results in predicable and consistent performance of the target assembly 10 in stopping arrows (not shown). With use, the layers 20 may become permanently compressed or damaged from arrows, thus decreasing the degree of layer compression resulting from placement of the barrel elements 66 in the first receptacle 42. Placement of the barrel elements 66 in the second receptacle 44 in one or both of the end caps 30, 50 allows the target assembly 10 to be tightened back within the preferred degree of compression.

Following assembly, the target assembly 10 is ready for use. The target assembly 10 is placed at the desired distance from the shooter, in a location such that stray arrows (not shown) will not cause damage or injury. The target assembly 10 may be used with any type of arrow point combined with any type of arrow shaft. As the arrow point strikes the target assembly 10, the tip enters between the layers 20. Friction between the arrow point and the layers 20 quickly dissipates the kinetic energy of the arrow, safely capturing the arrow in the target assembly 10, yet causing minimal damage to the layers 20. The arrow may be then easily removed from the target assembly 10, and the layers 20 close back around where the arrow point had been captured.

Since the assembly cables 60 run along the lines of intersection 14 of the target faces 12, the probability of an arrow striking the assembly cable 60 is much reduced relative to the probability which would exist if the assembly cable 60 were running along a target face 12. Therefore, the present invention allows all four sides of the target assembly 10 formed by the edges of the layers 20 to be used as target faces. This greatly extends the useful life of the target assembly 10, as four target faces 12 are provided, rather than the two target surfaces provided by existing targets. Note also that if an assembly cable 60 is damaged, it may be easily and readily replaced. The target assembly 10 can be used either indoors or outdoors. The target assembly 10 may be used with any type of arrow or arrow point and is highly resistant to damage. The target assembly 10 is especially resistant to damage from broadhead-style arrow heads when compared to the prior art. The target assembly 10 is lightweight, portable, and weather-resistant. The target assembly 10 is durable, and particularly cost-effective, as the target provides four surfaces suitable for capturing arrows.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention.

I claim:

1. An archery target comprising:

first and second end caps having a plurality of corners;

a plurality of layers of foam, each layer having a corresponding plurality of corners, the layers being stacked in general alignment with one another between the first and second end caps with the plurality of corners of the layers of foam being in alignment such that a plurality of target faces are formed by edges of the layers of foam; and a plurality of assembly cables connecting the first and second end caps, each cable being disposed generally along a line formed at an apex of the aligned corners of the layers of foam, each of the cables having a length which results in the layers of foam being compressed between the first and second end caps.

2. The archery target of claim 1, wherein the plurality of corners of the first and second end caps are generally aligned with the plurality of corners of the layers of foam.

3. The archery target of claim 1, wherein the cables are disposed generally along a line formed at an apex of the aligned corners of the layers of foam and the first and second end caps.

4. The archery target of claim 1, wherein the end caps and layers of foam are shaped as a rectangle.

5. The archery target of claim 1, wherein the layers of foam are closed cell polyethylene.

6. The archery target of claim 1, wherein each layer of foam has a thickness between approximately one-sixteenth and one-quarter of an inch.

7. The archery target of claim 1, wherein the first and second end caps are molded from a rigid polymeric material.

8. The archery target of claim 1, wherein ends of each assembly cable are generally in the form of a barrel.

9. The archery target of claim 8, wherein the first and second end caps are provided with at least one receptacle for each assembly cable, each receptacle being adapted to releasably receive a corresponding barrel.

10. The archery target of claim 9, wherein at least one of the first and second end caps are provided with at least a second receptacle for each assembly cable, the first and second receptacles being adapted to releaseably receive in the alternative the corresponding barrel.

* * * * *